US012410596B2

(12) United States Patent
Chen et al.

(10) Patent No.: US 12,410,596 B2
(45) Date of Patent: Sep. 9, 2025

(54) SINK WITH ASSEMBLED STAND

(71) Applicant: ZHUHAI DALI KITCHEN & BATHROOM TECHNOLOGY CO., LTD., Zhuhai (CN)

(72) Inventors: Jack Chen, Zhuhai (CN); Xiaoning Huang, Zhuhai (CN); Jimmy Nie, Zhuhai (CN)

(73) Assignee: ZHUHAI DALI KITCHEN & BATHROOM TECHNOLOGY CO., LTD., Zhuhai (CN)

( * ) Notice: Subject to any disclaimer, the term of this patent is extended or adjusted under 35 U.S.C. 154(b) by 166 days.

(21) Appl. No.: 18/448,212

(22) Filed: Aug. 11, 2023

(65) Prior Publication Data

US 2023/0383512 A1 Nov. 30, 2023

(30) Foreign Application Priority Data

Aug. 23, 2022 (CN) ..... 202211014596.1

(51) Int. Cl.
*E03C 1/33* (2006.01)
*E03C 1/182* (2006.01)

(52) U.S. Cl.
CPC ..... *E03C 1/335* (2013.01); *E03C 1/182* (2013.01)

(58) Field of Classification Search
CPC . E03C 1/32; E03C 1/326; E03C 1/328; E03C 1/33; A47K 1/00; A47K 1/02; A47K 1/05
See application file for complete search history.

(56) References Cited

U.S. PATENT DOCUMENTS 5,893,469 A * 4/1999 Nozawa ..... A47K 1/05 248/129
2006/0253974 A1 11/2006 Schneider et al.
2014/0259378 A1* 9/2014 Combs ..... A47K 1/02 4/643
2019/0331428 A1 10/2019 Arata et al.
2019/0387877 A1 12/2019 Shin et al.

* cited by examiner

*Primary Examiner* — Janie M Loeppke
(74) *Attorney, Agent, or Firm* — Hemisphere Law, PLLC; Zhigang Ma

(57) ABSTRACT

The present disclosure discloses a sink with an assembled stand. The sink includes a sink main body and an assembled stand; the assembled stand includes a left stand, a right stand, a connector and a surrounding panel; the connector connects the left stand with the right stand; the surrounding panel is mounted between the left stand and the right stand; the sink main body is movably mounted on the assembled stand; and the surrounding panel covers side surfaces of the sink main body. The present disclosure has the beneficial effects: The sink can flexibly meet requirements of a user for usage scenarios by a structural design of a sink supporting main body. Furthermore, a DIY product is provided to reduce the transportation cost, and the user can assemble the sink easily on the own.

8 Claims, 2 Drawing Sheets

SINK WITH ASSEMBLED STAND

TECHNICAL FIELD

The present disclosure relates to the technical field of sinks, in particular, to a sink with an assembled stand.

BACKGROUND

A sink is an important hardware product that holds water for household cleaning work. Sinks disclosed in the prior art are generally mounted in cabinets for use. Since the cost of building a sink is relatively high, the sink can only be used in a fixed area, and cannot be moved according to a service environment of a user. Furthermore, the transferring and transportation costs for the sink and the cabinet are relatively high, which are not conductive for replacement and selling of the sink.

SUMMARY

The present disclosure aims to provide a sink with an assembled stand. The sink can flexibly meet requirements of a user for usage scenarios by a structural design of a sink supporting main body. Furthermore, a DIY product is provided to reduce the transportation cost, and the user can assemble the sink easily on the own.

In order to achieve the foregoing invention objective, the present disclosure provides the following technical solution.

A sink with an assembled stand includes a sink main body and an assembled stand; the assembled stand includes a left stand, a right stand, a connector and a surrounding panel; the connector connects the left stand with the right stand; the surrounding panel is mounted between the left stand and the right stand; the sink main body is movably mounted on the assembled stand; and the surrounding panel covers side surfaces of the sink main body.

Preferably, the surrounding panel includes a front baffle plate, a rear baffle plate, a left baffle plate and a right baffle plate; the front baffle plate is mounted at a front end of the assembled stand; the rear baffle plate is mounted at a rear end of the assembled stand; the left baffle plate is mounted at a left end of the assembled stand; and the right baffle plate is mounted at a right end of the assembled stand. The surrounding panel is molded by machining and assembling, which can ensure that the surrounding panel is mounted firmly and difficult to fall off.

Preferably, the surrounding panel is integrally formed. The surrounding panel with four surfaces is formed by bending a sheet metal part, and the surrounding panel is then mounted between the left stand and the right stand, thus completing the mounting the surrounding panel.

Preferably, the connector includes a lower connection pipe and an upper connection pipe; the lower connection pipe is connected to lower ends of the left stand and the right stand through steel corners or threads or in a welded manner; and the upper connection pipe is connected to upper ends of the left stand and the right stand. It can ensure that the left stand and the right stand are connected firmly. The assembled stand can support the sink, so that collapse caused by a too heavy sink full of water is avoided.

Preferably, the assembled stand is further provided with adjustable foot pads; and the adjustable foot pads are mounted at bottom ends of the left stand and the right stand. The adjustable foot pads can adjust the height, so that the phenomenon of inclination of the sink due to different heights of the left stand and the right stand is avoided.

Preferably, the sink main body is fixed on the assembled stand by glue. It can ensure that the sink will not be overturned by a user during use and can be removed when not used. The sink is convenient to use.

Preferably, the sink main body is fixed on the assembled stand in a riveting or threaded connection manner. It can ensure that the sink will not be overturned by a user during use and can be removed when not used. The sink is convenient to use.

Preferably, the sink main body is fixed on the assembled stand by means of welding. It can ensure that the sink will not be overturned by a user during use.

Compared with the prior art, the present disclosure has the following beneficial effects.

According to the present disclosure, the assembled stand is provided, which is formed by connecting the left stand, the right stand and the connector. The position of the sink main body will not be limited by a cabinet. The sink main body can be directly mounted on the assembled stand. The position of the sink main body can change with the placement position of the assembled stand. Furthermore, the assembled stand can be directly disassembled into the left stand, the right stand, the connector and the surrounding panel for transportation, which can save the production and transportation cost. When receiving the product, a user can assemble the assembled stand at a selected position, and put the sink main body into the assembled stand, thus completing a household sink on the own. Replacement and use of the product are facilitated.

The surrounding panel is further arranged in the assembled stand of the present disclosure. The surrounding panel is mounted between the left stand and the right stand, which can further improve the stability of connection between the left stand and the right stand, and it is hard for the assembled stand to collapse and deform. When the sink main body is movably mounted on the assembled stand, the surrounding panel can cover the side surfaces of the sink main body to avoid side walls of the sink from being exposed to affect the attractive appearance of the household sink, and the visual perception of the user is better.

Therefore, the present disclosure provides a sink with an assembled stand. The sink can flexibly meet requirements of a user for usage scenarios by a structural design of a sink supporting main body. Furthermore, a DIY product is provided to reduce the transportation cost, and the user can assemble the sink easily on the own.

DETAILED DESCRIPTION OF THE EMBODIMENTS

The technical solutions in the embodiments of the present disclosure will be described clearly and completely below in combination with the accompanying drawings of the embodiments of the present disclosure. Apparently, the described embodiments are only part of the embodiments of the present disclosure, not all embodiments. All other embodiments obtained by those of ordinary skill in the art based on the embodiments in the present disclosure without creative work shall fall within the protection scope of the present disclosure.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Thus, the features defined with "first" and "second" may expressly or implicitly include at least one of the features; secondly, in the description of the present disclosure, "plurality" means at least two, for example two, three, etc., unless expressly specifically limited otherwise.

In the present disclosure, unless otherwise expressly specified and defined, terms "connection", "fixing" and the like are broadly understood. For example, "fixing" may be fixed connection, detachable connection, integration, mechanical connection, electrical connection, direct connection, indirect connection by using an intermediate medium, interior connection between two elements, or interaction between two elements. Unless otherwise expressly defined, a person of ordinary skill in the art may understand specific meanings of the foregoing terms in the present disclosure according to a specific situation.

In addition, the technical solutions between the various embodiments of the present disclosure can be combined with each other, but it must be based on what can be achieved by those of ordinary skill in the art. When the combination of technical solutions is contradictory or cannot be achieved, it should be considered that such a combination of technical solutions does not exist, and is not within the scope of protection claimed by the present disclosure.

Figure 1:
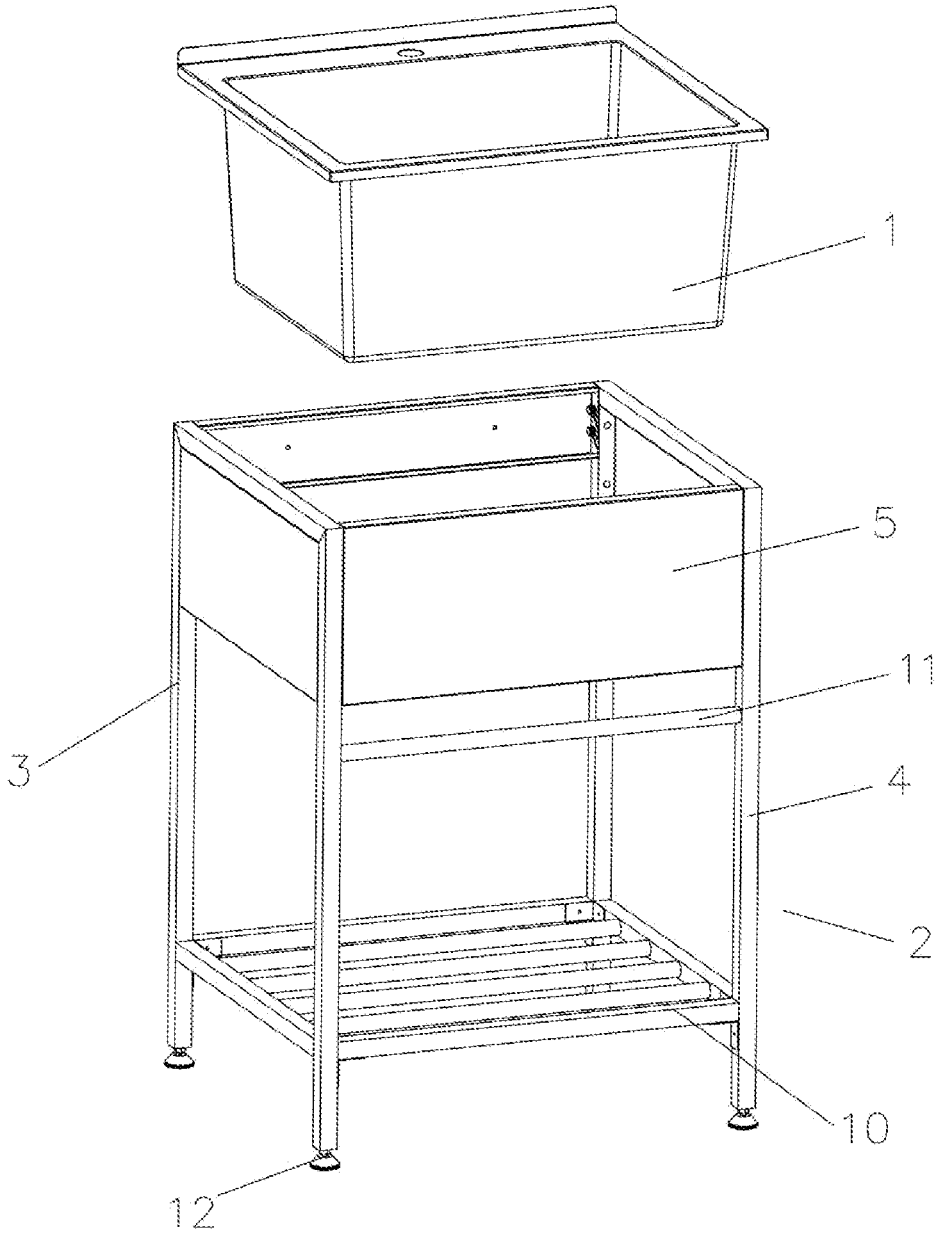
FIG. 1 is a schematic diagram of an entire structure of the present disclosure.
Figure 2:
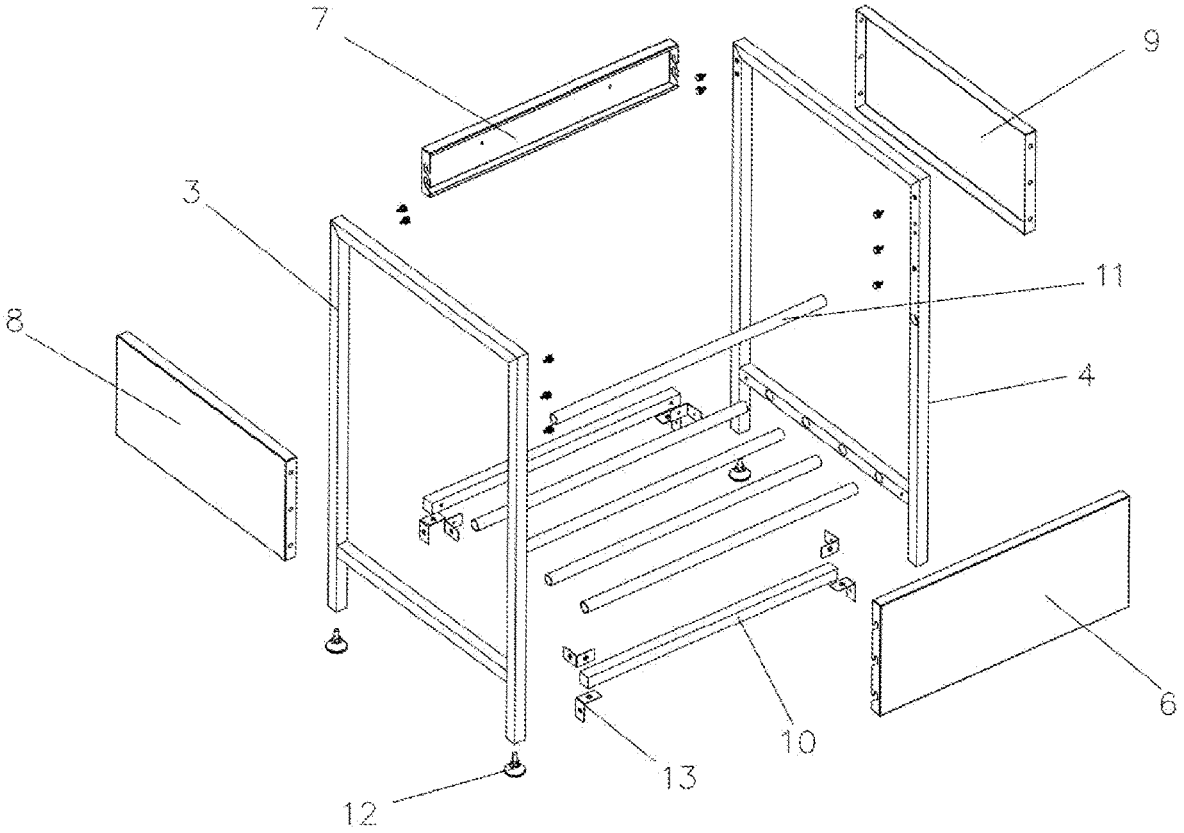
FIG. 2 is a schematic diagram of a split structure of an assembled stand in the present disclosure.

Referring to FIG. 1-FIG. 2, FIG. 1 is a schematic diagram of an entire structure of the present disclosure; and FIG. 2 is a schematic diagram of a split structure of an assembled stand in the present disclosure.

An embodiment of the present disclosure provides a sink with an assembled stand. Names of components corresponding to all reference numerals in the drawings are as follows: sink main body 1, assembled stand 2, left stand 3, right stand 4, surrounding panel 5, front baffle plate 6, rear baffle plate 7, left baffle plate 8, right baffle plate 9, lower connection pipe 10, upper connection pipe 11, adjustable foot pads 12, and steel corners 13.

A sink with an assembled stand includes a sink main body 1 and an assembled stand 2; the assembled stand 2 includes a left stand 3, a right stand 4, a connector and a surrounding panel 5; the connector connects the left stand 3 with the right stand 4; the surrounding panel 5 is mounted between the left stand 3 and the right stand 4; the sink main body 1 is movably mounted on the assembled stand 2; and the surrounding panel 5 covers side surfaces of the sink main body 1.

The connector includes a lower connection pipe 10 and an upper connection pipe 11; the lower connection pipe 10 is connected to lower ends of the left stand 3 and the right stand 4 through steel corners 13 or threads or in a welded manner; and the upper connection pipe 11 is connected to upper ends of the left stand 3 and the right stand 4. It can ensure that the left stand 3 and the right stand 4 are connected firmly. The assembled stand 2 can support the sink, so that collapse caused by a too heavy sink full of water is avoided.

The assembled stand 2 is further provided with adjustable foot pads 12; and the adjustable foot pads 12 are mounted at bottom ends of the left stand 3 and the right stand 4. The adjustable foot pads 12 can adjust the height, so that the phenomenon of inclination of the sink due to different heights of the left stand 3 and the right stand 4 is avoided.

Embodiment I: The assembled stand 2 includes a left stand 3, a right stand 4, a connector and a surrounding panel 5. The surrounding panel 5 includes a front baffle plate 6, a rear baffle plate 7, a left baffle plate 8 and a right baffle plate 9. The sink main body is fixed on the assembled stand by glue.

Use and working methods of Embodiment I: The left stand 3 and the right stand 4 are connected through the lower connection pipe 10 and the steel corner 13, and the left stand 3 and the right stand 4 are then connected together through the upper connection pipe 11. The front baffle plate 6 is mounted at a front end of the assembled stand 2; the rear baffle plate 7 is mounted at a rear end of the assembled stand 2; the left baffle plate 8 is mounted at a left end of the assembled stand 2; and the right baffle plate 9 is mounted at a right end of the assembled stand 2, thus assembling and forming the assembled stand 2. During use, the sink main body 1 is put into a top of the assembled stand 2. The sink main body 1 is fixed on the assembled stand 2 by glue. When not used, the sink main body 1 and the assembled stand 2 are separated, and the sink main body 1 is taken out, thus completing disassembling of the sink.

Embodiment II: The assembled stand 2 includes a left stand 3, a right stand 4, a connector and a surrounding panel 5. The surrounding panel 5 is integrally formed.

Use and working methods of Embodiment II: The left stand 3 and the right stand 4 are connected by the lower connection pipe 10 in a threaded connection manner, and the left stand 3 and the right stand 4 are then connected together through the upper connection pipe 11. The surrounding panel 5 is mounted between the left stand 3 and the right stand 4, thus assembling and forming the assembled stand 2. During use, the sink main body 1 is put into a top of the assembled stand 2. The sink main body 1 is fixed on the assembled stand 2 in a riveting or threaded connection manner. When not used, a rivet or a screw is removed, and the sink main body 1 is taken out, thus completing disassembling of the sink.

Embodiment III: The assembled stand 2 includes a left stand 3, a right stand 4, a connector and a surrounding panel 5. The surrounding panel 5 is integrally formed.

Use and working methods of Embodiment III: The left stand 3 and the right stand 4 are connected by the lower connection pipe 10 by means of welding, and the left stand 3 and the right stand 4 are then connected together through the upper connection pipe 11. The surrounding panel 5 is mounted between the left stand 3 and the right stand 4, thus assembling and forming the assembled stand 2. During use, the sink main body 1 is put into a top of the assembled stand 2. The sink main body 1 is fixed on the assembled stand 2 by way of welding.

Compared with the prior art, the present disclosure has the following beneficial effects.

According to the present disclosure, the assembled stand 2 is provided. The assembled stand 2 is formed by connecting the left stand 3, the right stand 4 and the connector 5. The position of the sink main body 1 will not be limited by a cabinet. The sink main body 1 can be directly mounted on the assembled stand 2. The position of the sink main body 1 can change with the placement position of the assembled stand 2. Furthermore, the assembled stand 2 can be directly disassembled into the left stand 3, the right stand 4, the connector and the surrounding panel 5 for transportation, which can save the production and transportation cost. When receiving the product, a user can assemble the assembled stand 2 at a selected position, and put the sink main body 1 into the assembled stand 2, thus completing a household sink on the own. Replacement and use of the product are facilitated.

The surrounding panel 5 is further arranged in the assembled stand 2 of the present disclosure. The surrounding panel 5 is mounted between the left stand 3 and the right stand 4, which can further improve the stability of connection between the left stand 3 and the right stand 4, and it is hard for the assembled stand to collapse and deform. When the sink main body 1 is movably mounted on the assembled stand 2, the surrounding panel 5 can cover the side surfaces of the sink main body 1 to avoid side walls of the sink from being exposed to affect the attractive appearance of the household sink, and the visual perception of the user is better.

Therefore, the present disclosure provides a sink with an assembled stand. The sink can flexibly meet requirements of a user for usage scenarios by a structural design of a sink supporting main body. Furthermore, a DIY product is provided to reduce the transportation cost, and the user can assemble the sink easily on the own.

The above descriptions are only the preferred embodiments of the present disclosure. It should be noted that the above preferred implementations should not be regarded as limitations to the present disclosure, and the protection scope of the present disclosure should be based on the scope defined by the claims. Those of ordinary skill in the art can also make several improvements and retouches without departing from the spirit and scope of the present disclosure, and these improvements and retouches shall also fall within the protection scope of the present disclosure.

What is claimed is:

1. A sink with an assembled stand, wherein the sink comprises a sink main body and an assembled stand; the assembled stand comprises a left stand, a right stand, a connector and a surrounding panel;

wherein the left stand and the right stand each are rectangular shaped; the surrounding panel comprises a front baffle plate, a rear baffle plate, a left baffle plate and a right baffle plate; the assembled stand comprises an assembled state that the left stand and the right stand are assembled by the connector, and the front baffle plate, the rear baffle plate, the left baffle plate and the right baffle plate are detachably mounted at side surfaces of the assembled left stand and right stand to form a receiving space therebetween, the sink main body is detachably mounted in the receiving space; and a disassembled state that the left stand, the right stand, the connector, the front baffle plate, the rear baffle plate, the left baffle plate and the right baffle plate are detached from each other for transportation.

2. The sink with the assembled stand according to claim 1, wherein the connector comprises a lower connection pipe and an upper connection pipe; the lower connection pipe is connected to lower ends of the left stand and the right stand through steel corners or threads or in a welded manner; and the upper connection pipe is connected to upper ends of the left stand and the right stand.

3. The sink with the assembled stand according to claim 1, wherein the assembled stand is further provided with adjustable foot pads; and the foot pads are mounted at bottom ends of the left stand and the right stand.

4. The sink with the assembled stand according to claim 1, wherein the sink main body is fixed on the assembled stand by glue.

5. The sink with the assembled stand according to claim 1, wherein the sink main body is fixed on the assembled stand in a riveting or threaded connection manner.

6. The sink with the assembled stand according to claim 1, wherein the sink main body is fixed on the assembled stand by means of welding.

7. A sink, comprising:

a sink main body; and a detachable stand for DIY assembly, the detachable stand comprising a left stand, a right stand, a connector and a surrounding panel;

wherein the left stand and the right stand each are rectangular shaped; the surrounding panel comprises a front baffle plate, a rear baffle plate, a left baffle plate and a right baffle plate; the detachable stand comprises an assembled state that the left stand and the right stand are assembled by the connector, and the front baffle plate, the rear baffle plate, the left baffle plate and the right baffle plate are detachably mounted at side surfaces of the assembled left stand and right stand to form a receiving space therebetween, the sink main body is detachably mounted in the receiving space; and a disassembled state that the left stand, the right stand, the connector, the front baffle plate, the rear baffle plate, the left baffle plate and the right baffle plate are detached from each other for transportation.

8. The sink according to claim 7, wherein the connector comprises a lower connection pipe and an upper connection pipe; the lower connection pipe is connected to lower ends of the left stand and the right stand through steel corners or threads or in a welded manner; and the upper connection pipe is connected to upper ends of the left stand and the right stand.

* * * * *